United States Patent [19]

LaSpisa et al.

[11] Patent Number: 4,739,714

[45] Date of Patent: Apr. 26, 1988

[54] INCINERATOR COMBUSTION FUEL CONTROL

[75] Inventors: Ronald J. LaSpisa; Thomas J. Hubbard, both of Bartlesville, Okla.

[73] Assignee: Incinatrol, Denver, Colo.

[21] Appl. No.: 82,152

[22] Filed: Aug. 6, 1987

[51] Int. Cl.[4] ..... F23N 5/00

[52] U.S. Cl. ..... 110/187; 110/346; 431/12; 431/90

[58] Field of Search ..... 110/185, 186, 187, 203, 110/210, 212, 101 C, 101 CF, 101 R, 346; 236/15 BD; 431/19, 62, 75, 76, 12, 90

[56] References Cited

U.S. PATENT DOCUMENTS

| | | | |
|---|---|---|---|
| 3,605,655 | 9/1971 | Warshawsky et al. | 110/186 |
| 3,734,675 | 5/1973 | Osburn | 431/12 |
| 4,038,032 | 7/1977 | Brewer . | |
| 4,140,067 | 2/1979 | Jensen | 110/187 |
| 4,144,997 | 3/1979 | Anderson et al. | 236/15 BF |
| 4,320,709 | 3/1982 | Hladun | 110/235 |
| 4,424,754 | 1/1984 | Coleman et al. | 110/185 X |
| 4,459,923 | 7/1984 | Lewis | 110/185 X |
| 4,520,741 | 6/1985 | Carbeau et al. | 110/344 |

FOREIGN PATENT DOCUMENTS

| | | | |
|---|---|---|---|
| 2584480 | 1/1987 | France | 110/186 |
| 75122 | 6/1980 | Japan | 110/186 |

*Primary Examiner*—Steven E. Warner
*Attorney, Agent, or Firm*—G. E. Bogatie

[57] ABSTRACT

The flow rate of multiple fuel streams supplied to an incinerator are controlled so as to provide maximum temperature and heat release conditions in the incinerator that will allow complete combustion of hazardous waste fuel. In addition, a minimum temperature for the incinerator is maintained by manipulating the flow rate of an auxiliary fuel such as natural gas, that is also supplied to the incinerator. In use, a control signal for manipulating a waste fuel flow is selected as the lowest signal of signals representative of a maximum temperature for the incinerator, a maximum heat release rate for the incinerator, a maximum heat release rate for a particular waste fuel, a maximum pressure for the incinerator, and the combustion air available.

46 Claims, 5 Drawing Sheets

INCINERATOR COMBUSTION FUEL CONTROL

This invention relates to incineration of hazardous waste material. In one aspect it relates to apparatus for controlling combustion fuel supplied to an incinerator. In another aspect it relates to a method for automatically manipulating combustion fuel supplied to a hazardous waste incinerator so as to maintain the temperature conditions required under State and/or Federal regulations for the particular waste being burned.

BACKGROUND OF THE INVENTION

Incineration is a process used to burn waste substances in which all of the combustion factors, i.e. temperature, retention time, turbulence, and air supply, can be controlled. One of the basic requirements for incineration is therefore to maintain an operating temperature sufficient for waste destruction such that the temperature is high enough to heat all waste components above their respective ignition temperatures. In addition complete combustion requires a heat release rate in the incinerator high enough to provide energy input to incoming wastes in excess of the respective activation energies. As used herein "activation energy" is the quantity of heat needed to destabilize molecular bonds and form intermediates so that the combustion reaction will proceed. In cases where combustion intermediates are most stable than the original waste constituents, higher temperatures are required for complete combustion of the intermediate than for parent compound destruction.

Due to an increase in environmental awareness and a decrease in available sites for land-fill operations, incineration systems are playing an increasing role in the field of waste management. The use of incineration systems is especially preferred in the disposal of various hazardous wastes. However, incineration of hazardous waste material inherently poses a serious threat to environmental concerns, and is therefore regulated by State and Federal agencies. These regulations require complete combustion of the hazardous waste in order to effect control of emissions released to the atmosphere. It is thus necessary that computer systems be developed which can closely monitor and control the waste destruction process to insure that complete combustion of the hazardous waste material has taken place, and which can respond rapidly to compensate for upsets that can occur in the combustion process.

Accordingly it is a primary object of this invention to provide a method and apparatus for controlling the flow rates of multiple fuel streams to an incinerator where each fuel stream has a different heat value. Another object of this invention is to maintain an incinerator, that is heated by the multiple fuel stream, at a temperature required for complete combustion of waste material under regulations such as specified by the Federal Resources Conservation and Recovery Act (RCRA) for industrial waste disposal. It is a still further object of this invention to maximize the feed rate of waste fuel streams to the incinerator within the constraints permitted under the RCRA regulations.

SUMMARY OF THE INVENTION

In accordance with one aspect of the present invention method and apparatus are provided for automatically controlling the flow rate of multiple fuel streams to an industrial incinerator. The flow of waste fuel and of auxiliary fuel to the incinerator is controlled so as to automatically maintain temperatures in a combustion zone above a specified minimum temperature and below a specified maximum temperature. In addition, the maximum heat release rate for each high heat value waste fuel as well as the total heat release rate of all fuels is maintained below a maximum value specified by the regulating agency for an analyzed batch of waste.

The minimum temperature for ignition of all waste components, and the maximum heat release rate permitted for activation energy of an analyzed batch of waste are specified for the particular size of incinerator by the regulating agency. The actual heat value for each waste fuel stream and each auxiliary fuel stream is predetermined by the operator. The heat release rate for each fuel, i.e. both waste fuel and auxiliary fuel, is determined by multiplying the flow rate of each fuel by its respective heat value. Next a maximum flow rate for each high heat value waste fuel supplied to the combustion zone is determined responsive to the total heat release rate of all waste fuels supplied to the combustion zone. For example, assume a high heat value waste oil stream, a low heat value waste water stream, and a low heat value solid waste stream are fed to the combustion zone. As used herein a high heat value waste fuel is no less than 16,000 BTU/lb. In addition an auxiliary fuel such as natural gas is supplied to the combustion zone. A first limiting value for the maximum rate of waste oil supplied to the combustion zone is determined by summing the total heat release rate supplied to the combustion zone by all of the waste fuels except the waste oil i.e. the waste water and the solid waste stream, and subtracting this sum from the maximum waste oil heat release rate permitted by the regulating agency for the waste oil fuel. The remainder is divided by the waste oil heat value to determine the first maximum limiting value or constraint for the waste oil flow.

A similar calculation provides another maximum value or constraint for the waste oil flow that is responsive to the maximum permitted heat release rate of all fuels supplied to the combustion zone. In addition, constraints which are responsive to (1) the maximum permitted combustion zone temperature, and (2) the maximum permitted combustion zone pressure, can be provided if desired. Yet a fifth maximum value for waste oil flow can be entered by an operator, if desired.

The low select of these signals, each of which typifies a particular limiting value for the waste oil flow rate, provides the actual control signal for the waste oil flow rate, if the air required is available. If sufficient air is not available, the waste oil flow rate is limited by the available air flow. Select circuits are also provided for each low heat value waste fuel stream. In addition a minimum combustion zone temperature is maintained by controlling the flow of an auxiliary fuel to the combustion zone.

The waste fuel streams to the incinerator are thus regulated with respect to each other and with respect to the auxiliary fuel stream. This promotes efficient use of the auxiliary fuel since after startup the auxiliary fuel is only required to maintain the low temperature conditions during operation of the incinerator when the waste fuel fails to maintain the required low temperature.

Additional objects and advantages of the invention will be apparent from the following description of a preferred embodiment of the invention as illustrated by the drawings in which:

DESCRIPTION OF THE PREFERRED EMBODIMENT

The invention is illustrated and described in terms of a rotary kiln type incinerator which accepts waste in solid, liquid or gaseous form and also accepts an auxiliary fuel stream which is typically natural gas or fuel oil. The incinerator also includes an afterburner which insures complete combustion of exhaust gases from the kiln and in addition the afterburner accepts a liquid or gaseous waste fuel and an auxiliary fuel.

Although the invention is described in terms of a rotary kiln type incinerator with an afterburner and having five conduits for supplying waste material, and which is capable of processing solid, liquid, or gaseous waste, the applicability of the invention extends to any other type of incinerator which must rely on multiple fuel streams of differing heat value to provide energy for complete combustion of the waste material. The invention is not limited by the number of waste material streams supplied to the incinerator. Some pertinent incineration processes in addition to the described rotary kiln process include liquid injection processes, fluidized bed processes, etc.

Figure 1:
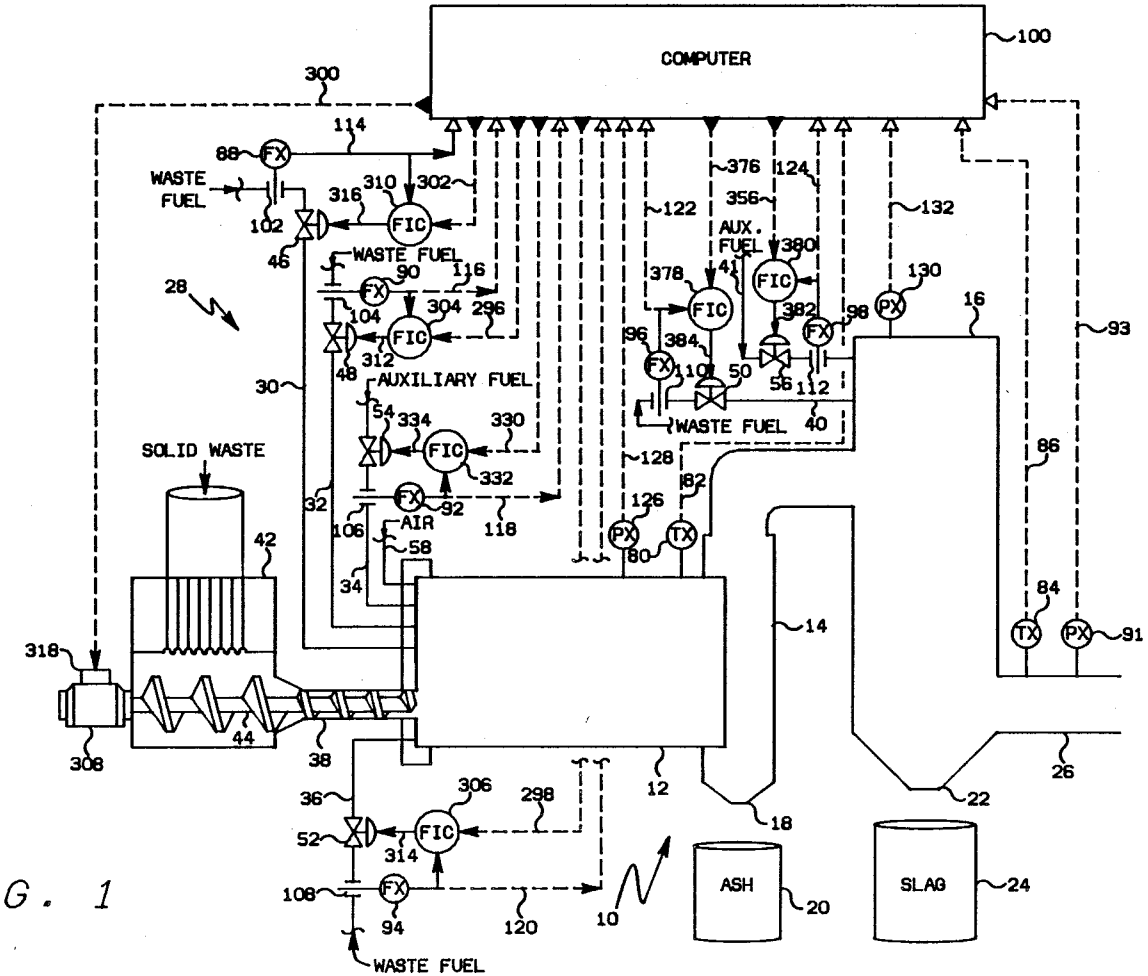
FIG. 1 is a diagrammatic illustration of an incinerator with its associated control system.

Only those portions of the incinerator control system necessary to illustrate the present invention are illustrated in FIG. 1. A large number of additional control devices will be utilized to control an incinerator, but these additional control devices have not been illustrated for the sake of clarity in illustrating the present invention.

A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Generally, the signals associated with any computer or any transducer are electrical in form. However, the signals provided from flow sensors will generally be pneumatic in form. Transducing of these signals is not illustrated for the sake of simplicity because it is well known in the art that if a flow is measured in pneumatic form it must be transduced to electrical form if it is to be transmitted in electrical form by a flow transducer. Also, transducing of the signals from analog form to digital form or from digital form to analog form is not illustrated because such transducing is also well known in the art.

The invention is also applicable to mechanical, hydraulic or other signal means for transmitting information. In almost all control systems some combinations of electrical, pneumatic, mechanical or hydraulic signals will be used. However, use of any other type of signal transmission, compatible with the process and equipment in use, is within the scope of the invention.

A digital computer is used in the preferred embodiment of this invention to calculate the required control signals based on measured process parameters as well as data supplied to the computer. Analog computers or other types of computing devices could also be used in the invention. The digital computer is preferably an OPTROL® DCS Process Computer System from Applied Automation, Inc., Bartlesville, Okla.

The controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention. The operation of proportional-integral-derivative controllers is well known in the art. The output control signal of a proportional-integral-derivative controller may be represented as $$S=K_1E+K_2\int Edt+K_3dE/dt$$

where

S=output control signals;

E=difference between two input signals; and $K_1$, $K_2$ and $K_3$=constants.

The scaling of an output signal by a controller is well known in control systems art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flows equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or conbinations of one or more of such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specifc measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to FIG. 1 there is illustrated an incinerator generally designated at 10 which comprises a feed system generally indicated at 28, a rotary kiln 12, a kiln combustion products transfer duct 14, an afterburner 16, and an afterburner combustion product transfer duct 26. The rotary kiln 12, which is mounted at a slight incline from the horizontal plane, transfers its combustion gases through duct means 14 to the afterburner 16 to insure complete combustion prior to treatment for air pollutants. The bottom ash that remains in the kiln 14 after a material is incinerated is removed through ash gate 18 in container 20 and the slag formed in afterburner 16 is removed through gate 22 in container 24. Combustion gases from the afterburner 16 are transferred through duct means 26 for further processing which can include quenching, scrubbing, separating, etc.

The feed system supplies hazardous/toxic waste to be burned in the incinerator through a plurality of fluid conduit means which can be equipped with waste burners if desired. Also a solid waste feeder conduit 38 is provided. Generally hazardous liquid or gaseous waste material is analyzed at least for composition and heating value and then stored in bulk storage tanks, not shown in FIG. 1, according to the analysis. The preanalyzed material is then supplied to the kiln 12 from bulk storage tanks, not shown, through conduit means 30 or 32, or is supplied to the afterburner through conduit means 40. Solid hazardous waste is analyzed prior to being shredded in shredder 42, compacted, and fed to the kiln 12 by an auger 44.

The hazardous waste material supplied through control valve 46 operably located in conduit means 30 is typically a low BTU waste fuel pumped to the kiln 12 from a bulk storage tank, not shown. The hazardous waste material supplied to the kiln 12 through control valve 48 operably located in conduit means 32, and which can also be supplied to the afterburner 16 through control valve 50 operably located in conduit means 40 is typically an organic material having a high BTU content. It is supplied to the kiln 12 and the afterburner 16 from bulk storage tanks not shown in FIG. 1.

An additional hazardous waste material can be supplied to the kiln through control valve 52 operably located in conduit means 36. Typically the hazardous waste supplied to the kiln 12 through conduit means 36 is material received in small quantities which is not suitable for mixing with the material stored in the bulk storage tanks to be supplied to the kiln 12 through conduit means 30 or 32.

An auxiliary fuel such as natural gas or fuel oil is also supplied to the kiln 12 and the afterburner 16 through control valves 54 and 56 respectively which are located in conduit means 34 and 41 respectively. Combustion air is also supplied through conduit 58.

As illustrated in FIG. 1 various control valves are utilized to manipulate the flow of waste fuel and the auxiliary fuel to the kiln and the afterburner as required for control of the incinerator. As will be described more fully hereinafter temperatures of the kiln and the afterburner are controlled by manipulating the flow rate of the waste fuels and the auxiliary fuel.

The processed measurements utilized to generate the control signals for control valves 46, 48, 50, 52, 54 and 56 are illustrated in FIG. 1. The manner in which the process measurements are combined to generate the required control signals is illustrated in FIGS. 3–6. The process measurement will first be described, thereafter the manner in which the process measurements are utilized to generate the control signals will be described.

Temperature transducer 80 in combination with a temperature measuring device such as a thermocouple, which is operably located in the effluent side of the kiln 12, provides an output signal 82 which is representative of the actual temperature of the combustion gases exiting the kiln 12. Signal 82 is provided from temperature transducer 80 as an input to computer 100. In like manner temperature transducer 84 in combination with a measuring device such as a thermocouple which is operably located in the combustion product duct 26 provides an output signal 86 which is representative of the temperature of the combustion gases exiting the afterburner. Signal 86 is also provided as an input to computer 100.

Flow transducer 88 in combination with flow sensor 102 which is operably located in conduit means 30 provides an output signal 114 which is representative of the actual flow rate of waste fuel through conduit means 30. Signal 114 is provided from the flow transducer 88 as an input to computer 100. In like manner flow transducers 90, 92, 94, 96 and 98 in combination respectively with flow sensor 104, 106, 108, 110 and 112 which are operably located in conduit means 32, 34, 36, 40 and 41 respectively and which respectively provide output signals 116, 118, 120, 122, and 124 which are representative of the respective actual flow rates in conduit means 32, 34, 36, 40 and 41. All of the flow signals are provided as inputs to computer 100.

Pressure transducer 126 provides an output signal 128 which is representative of the actual pressure in the kiln 12. In like manner pressure transducer 91 and 130 provide an output signals 93 and 132 which are respectively representative of the actual outlet and inlet pressure in the afterburner 16. Signals 93, 130 and 132 are provided as inputs to computer 100.

In response to the aforementioned process variables, the predetermined waste fuel analysis, and in response to process temperature set points determined by the regulating agency for the particular type of hazardous waste being burned, the computer 100 provides seven (7) control signals as will be more fully described hereinafter.

From the standpoint of conservation of auxiliary fuel, and of operating the incinerator 10 under RCRA standards, the temperature control strategy of the present invention is to preheat the kiln using the auxiliary fuel such as natural gas. Then burning waste fuel and controlling the maximum permitted temperature by manipulating the flow of waste fuel and controlling the minimum permitted temperature by manipulating the flow rate of the auxiliary fuel such that burning the waste fuel helps maintain the required temperature. In this manner the flow rate of auxiliary fuel is reduced to supply less heat to the incinerator 10 so long as the decrease in auxiliary fuel does not cause violation of an RCRA standard.

Figure 2:
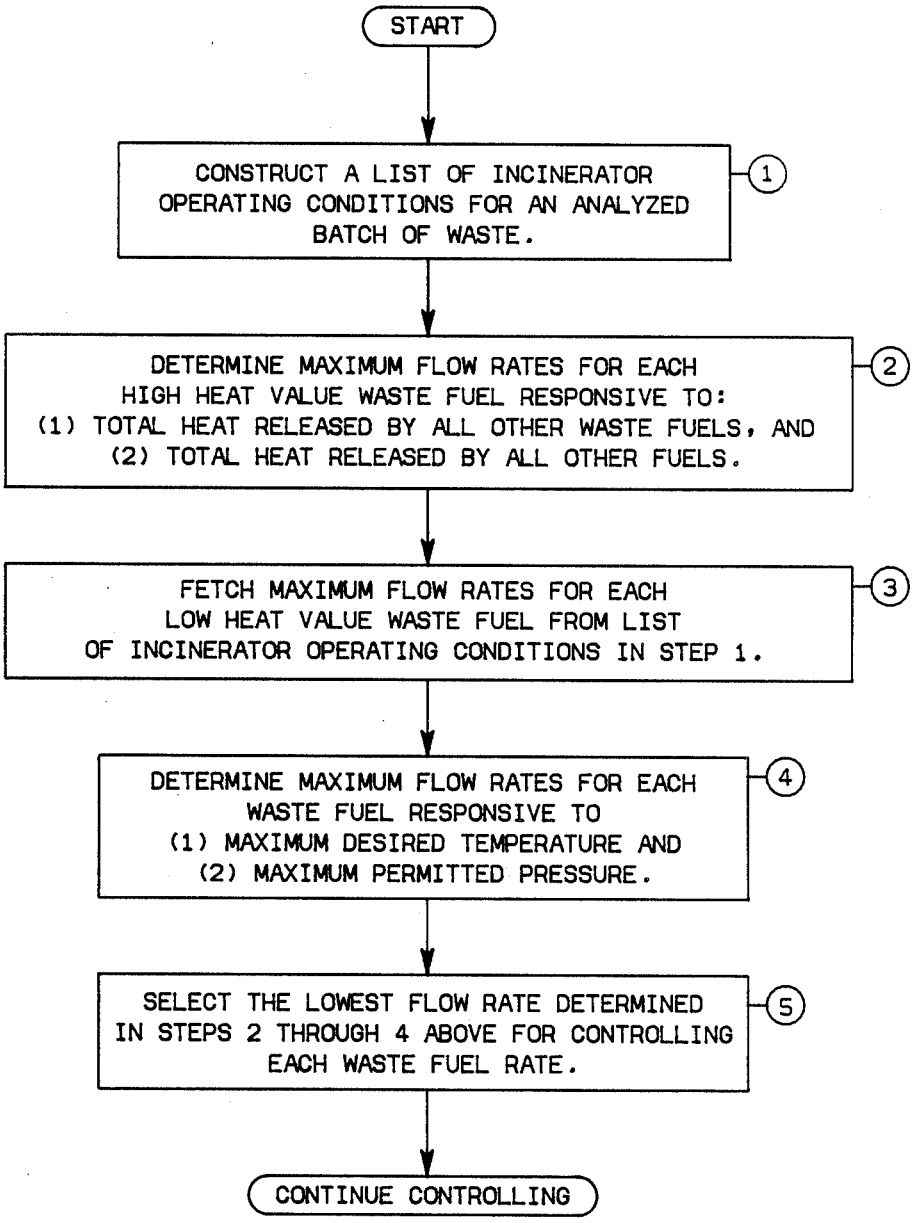
FIG. 2 is a simplified computer flow chart utilized to determine control signals for waste fuel flow.

In FIG. 2 there is illustrated a flow chart for determining flow rates required for each of the waste fuels. A basic factor in this flow chart is to construct a list of incinerator operating conditions for an analyzed batch of waste. This list is constructed from the permitted operating conditions set forth by the regulating agency. Table I below is an example of temperature and heat release operating conditions for a hazardous waste incinerator having a nominal capacity of burning 13,000,000 BTU/hr.

TABLE I

| CONDITION* | A | B | C | D |
|---|---|---|---|---|
| Maximum Heat Release (MMBTU/HR) | | | | |
| TOTAL | 15.3 | 13.8 | 18.5 | 15.3 |
| High Heat Waste in Kiln | 6.5 | 5.1 | 10 | 0 |
| High Heat Waste in Afterburner | 0 | 8.7 | 8.5 | 0 |
| Maximum Kiln Temp. (°F.) | 1630 | 1640 | 1700 | 1630 |
| Maximum Afterburner Temp. (°F.) | 2590 | 2530 | 2400 | 2590 |
| Minimum Kiln Temp. (°F.) | 1130 | 1140 | 1200 | 1130 |
| Minimum Afterburner Temp. (°F.) | 2090 | 2030 | 1900 | 2090 |
| Maximum Solids Feed Rate (lbs./hr) | 0 | 0 | 220 | 0 |
| Maximum Aqueous Feed Rate (lbs./hr) | — | — | — | 570 |

*Condition A - Waste Fuel to Kiln Only
Condition B - Waste Fuel to Kiln and Afterburner
Condition C - Solid Waste to Kiln
Condition D - Low Heat Value Liquid to Kiln, Gas to Afterburner The heat release rate and the temperature conditions set forth in Table I are determined by the regulating agency to be sufficient temperature conditions to achieve a destruction efficiency of 99.99% for each principle organic hazardous constituent incinerated.

Utilizing the maximum heat release conditions and maximum and minimum temperatures listed in Table I, corresponding flow rates for each waste fuel are determined as illustrated in FIGS. 3–6.

Figure 4:
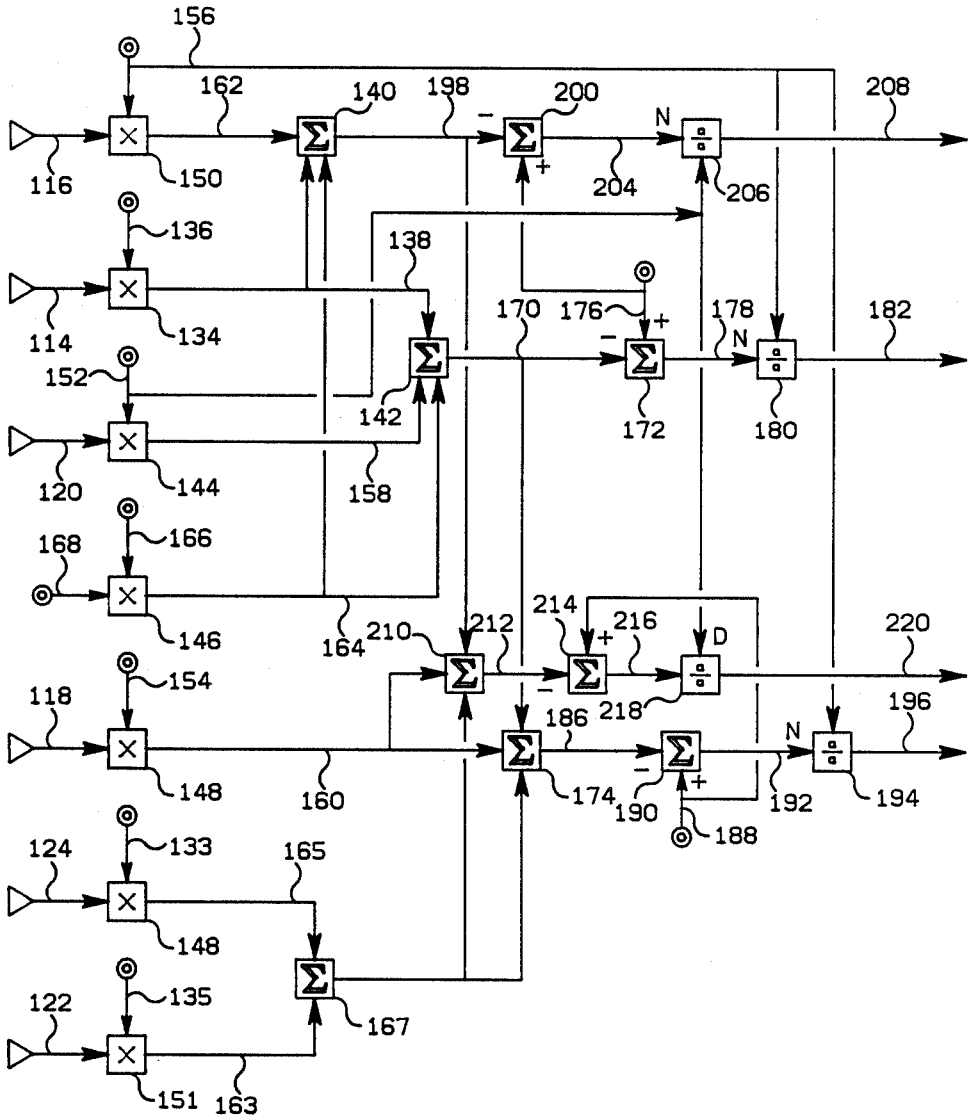
FIG. 4 is a block diagram of the preferred computer logic utilized to calculate maximum flow rates for high heat value waste fuels.

Referring now to FIG. 4, signal 114 which is representative of the actual flow rate of waste fuel flowing in conduit means 30 is provided to multiplying block 134. Signal 136 which is an operator entered input representative of the predetermined heating value of the waste fuel flowing in conduit means 30 is provided as a second input to multiplying block 134. Signal 136 is multiplied by signal 114 to establish signal 138 which is representative of the actual heat release rate of the waste fuel flowing in conduit means 30. Signal 138 is provided to summing blocks 140 and 142.

In a similar manner signals representative of the actual heat release rate for each fuel are provided to summing blocks as illustrated in FIG. 4. In particular signals 120, 118, 116, 122 and 124 which are representative of the flow rates in conduit means 36, 34, 32, 40 and 41 respectively are multiplied by signals 152, 154, 156, 135 and 133 which are operator entered signals representative of the respective predetermined heating values for the fluids flowing in conduit means 36, 34, 32, 40 and 41 to provide the respective heat release signals 158, 160, 162, 163 and 165 from multiplying blocks 144, 148, 150, 151 and 153. In addition signal 164 which is representative of the heat release rate for the solid waste material is determined by multiplying the heating value of the solid material represented by operator entered signal 166 by signal 168 which is an operator entered signal in accordance with the permitted sold flow rate as illustrated in Table I.

Signals 158 and 164 are summed with signal 138 in summation block 142 to establish signal 170 which is representative of the total heat release rate of all waste fuels supplied to the kiln except the waste fuel flowing in conduit means 32. Signal 170 is provided from summation block 142 to summation blocks 172 and 174. Summation block 172 is also provided with signal 176 which is representative of the maximum heat release rate permitted for high heat value waste fuel supplied to the kiln, as determined from Table I. Signal 170 subtracted from signal 176 in summation block 172 to establish signal 178 which is representative of the difference between signals 176 and 170. Signal 178 is provided to the numerator input of division block 180. Signal 156 which is representative of the acutal heating value for the fluid flowing in conduit means 32 is provided as a denominator input to division block 180. Signal 128 is divided by signal 156 in division block 180 to establish signal 182 which is representative of a first maximum value for the flow rate of fluid flowing in conduit means 32. As illustrated in FIG. 4, signal 182 is responsive to the actual heat release rate of all waste fuel supplied to the kiln except the heat release rate supplied by the waste fluid flowing in conduit means 32. Signal 182 is provided from division block 180 as a first input to low select block 184 illustrated in FIG. 3.

Signals 170, 160, and 155 are summed in block 174 to establish signal 186 which is representative of the total incinerator heat release rate except for the heat release rates supplied by the fluid flowing in conduit means 32. Signal 188 which is representative of the total permitted heat release rate for the incinerator as determined from Table I, is provided as a first input to summation block 190. Signal 186 is subtracted from signal 188 in summation block 190 to establish signal 192 which is representative of the maximum heat release rate permitted for the fluid flowing in conduit means 32. Signal 192 is divided by signal 156 in division block 194 to establish signal 196. Signal 196 is provided from division block 194 as a second input to low select block 184 illustrated in FIG. 3. Also as illustrated in FIG. 4, signal 196 is responsive to the total heat release rate of all waste fuels present in the incinerator except the heat release rate supplied by the fluid flowing in conduit means 32.

In a similar manner two maximum values for the fuel flowing in conduit means 36 are determined as illustrated in FIG. 4. In particular signals 162, 138 and 164 are summed in block 140 to establish signal 198 which is representative of the total heat release rate of all waste fuels supplied to the kiln except the waste fuels supplied through conduit means 36. Signal 198 is supplied to summation block 200. Signal 176 which is representative of the maximum permitted heat release rate for high heat value waste fuel flowing in conduit means 36, as determined from Table I, is provided as a second input to summation block 200. Signal 198 is subtracted from signal 176 in summation block 200 to establish signal 204 which is representative of the maximum permitted heat release rate for the fluid flowing in conduit means 36. Signal 204 is divided by signal 152 in division block 206 to establish signal 208 which is representative of a maximum permitted flow rate for the fluid flowing in conduit means 36. Signal 208 is provided from division block 206 as a first input to low select 222 illustrated in FIG. 4.

Signal 198 is summed with signals 155 and 160 in summation block 210 to establish signal 212. Signal 212 is provided from summation block 210 as a first input to summation block 214. Signal 188 which is representative of the maximum permitted total heat release rate for the incinerator as determined from Table I, is provided as a second input to summation block 214. Signal 212 is subtracted from signal 188 in summation block 214 to establish signal 216 which is representative of the maximum heat release rate permitted for the fluid flowing in conduit means 36. Signal 216 is divided by signal 152 in division block 218 to establish signal 220 which is representative of a maximum flow rate of fluid permitted in conduit means 36, and which as illustrated in FIG. 4, is responsive to the heat release rate of the auxiliary fuel and of all waste fuels except for the waste fuel flowing in conduit means 36. Signal 220 is provided from division block 218 as a second input to low select block 222 illustrated in FIG. 3.

Figure 3:
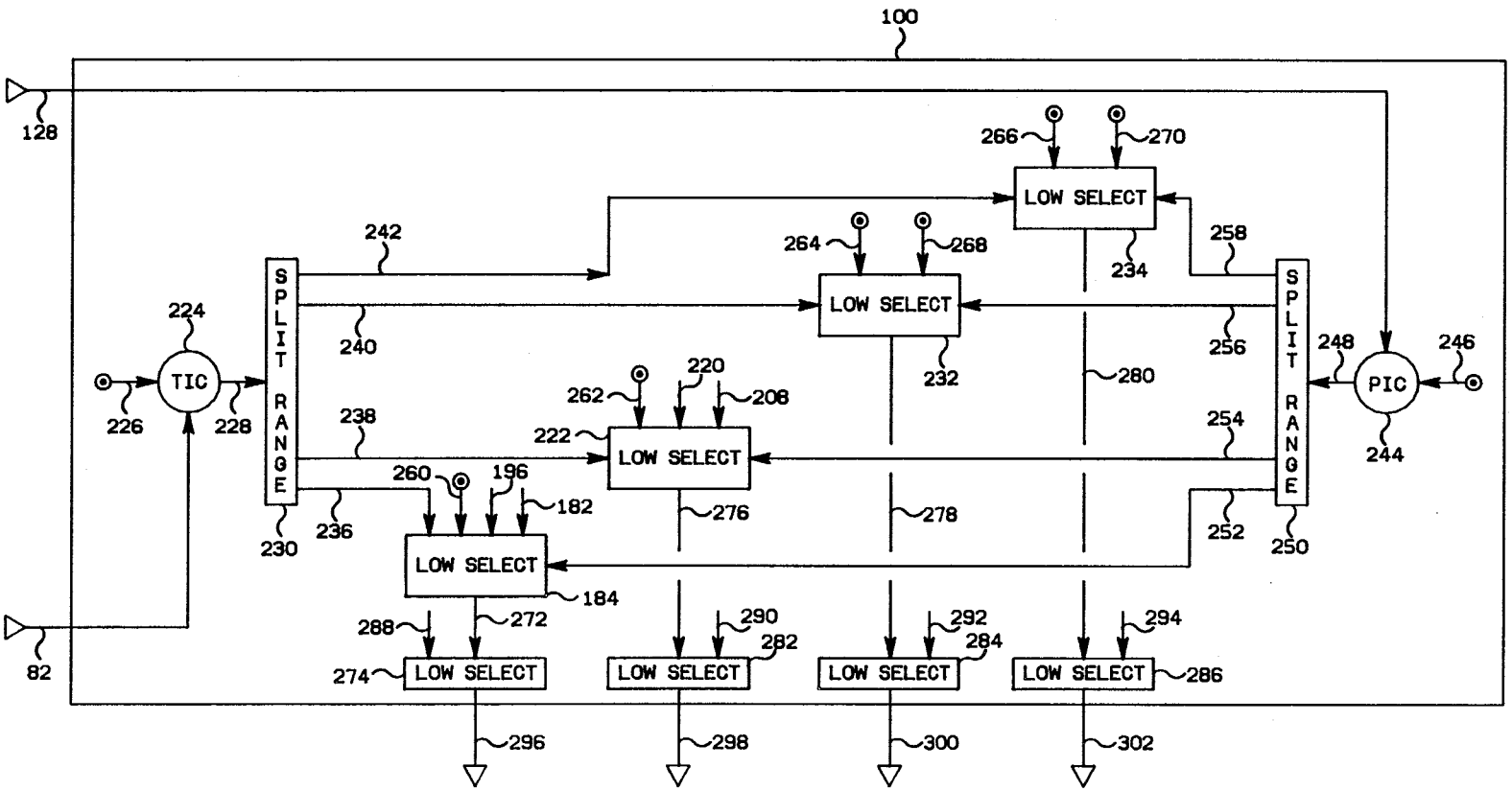
FIG. 3 is a block diagram of the preferred computer logic utilized to implement the desired waste feed control function for a kiln.

Referring now to FIG. 3, signal 82 which is representative of the temperature in the kiln 12 is provided as a process variable input to temperature controller 224. Signal 226, which is representative of the maximum kiln temperature illustrated in Table I, is provided as a set point signal for temperature controller 224. Temperature controller 224 provides an output signal 228 responsive to the difference between signals 226 and 82, and which is scaled so as to be representative of a flow rate required to maintain the actual kiln temperature substantially equal to the maximum temperature represented by signal 226. Signal 228 is provided from temperature controller 224 to a split-range computer block 230. As is well known to those skilled in the control systems art, in a split-range control system the full-scale output of the controller is divided to operate over two (2) or more portions of the full-range so that different portions of the controller output signal can manipulate different devices. In practice of the present invention the range of the temperature controller 224 is divided into four (4) portions such that priority can be achieved. For example the portion of the full-range signal provided to low select 184 can become its maximum value before the portion of the full-range signal provided to low select 222 achieves a magnitude other than zero. In this manner temperature controller 224 can completely stop the flow of a selected waste material in response to an increasing temperature before the flow rate of another stream is affected. Signals 236, 238, 240 and 242 which are each representative of a portion of the full-range of output signal 228 are provided respectively as inputs to select circuits 184, 222, 232 and 234.

Signal 128 which is representative of the kiln pressure, is provided as a process variable input to pressure controller 244. Signal 246 which is representative of a desired pressure is provided as a set point input to pressure controller 244. Pressure controller 244 provides an output signal 248 which is responsive to the difference between signals 128 and 246. Signal 248 is scaled so as to be representative of a flow rate required to maintain the actual pressure in the kiln 12 substantially equal to the desired pressure represented by set point signal 246. Signal 246 is provided from pressure controller 244 to split-range computer block 250. Signals 252, 254, 256 and 258 which are each representative of a portion of the full-range of output signal 248 are provided respectively as inputs to select circuits 184, 222, 232 and 234.

If desired low select blocks 184, 222, 232, and 234 can also be provided with operator entered signals for maximum flow rates of the various waste fuel streams. Signal 260 which is representative of a maximum desired flow rate of the waste fuel supplied through conduit means 32 is provided to low select block 184. In a similar manner, signals 262, 264 and 266 which are representative of maximum desired flow rates for waste fuel supplied through conduit means 36, 38 and 30 respectively are provided to low select blocks 222, 232 and 234 respectively.

Low select blocks 232 and 234 are also provided with maximum permitted flow rate signals 268 and 270 for solid waste and low BTU waste water respectively as determined from Table I.

In response to the plurality of flow signals representative of maximum flow rates for waste fuels, low select block 184 provides an output signal 272 which is representative of the lowest flow rate of the plurality of signals provided to the low select block 184. Signal 272 is provided from low select block 184 as an input to low select block 274. In a similar manner low select blocks 222, 232 and 234 provide output signals 276 278 and 280 respectively. Signals 276, 278 and 280 are provided as inputs to low select blocks 282, 284 and 286 respectively. Low select block 274, 282, 284 and 286 are also provided respectively with signals 288, 290, 292 and 294. Signal 288 is representative of the air flow required for complete combustion of the waste fuel flow represented by signal 272 and is effective for limiting fuel flow to the available air flow. If the actual air flow decreases below the rate required for full combustion, the air flow signal is selected to manipulate the fuel flow by low select block 274. In a similar manner signals 290, 292 and 294 limit the fuel flow represented by signals 276, 278 and 280 respectively to the available air flow.

Air flow signals 288, 290, 292 and 294 are computed signals based on measurement of the kiln air flow, measurement of each waste fuel flow rate, a predetermined air to fuel ratio for each waste fuel, and a predetermined excess oxygen factor. The limiting air flow signals for each waste fuel and the auxiliary fuel to the kiln are given by the general equation:

$$A_i = \left( M_i R_i / \sum_{1}^{5} M_i R_i \right) (AF/(R_i)(O_{2E}))$$

where:

M = Measured Flow Rate (lbs./hr.).
R = Predetermined Air to Fuel Ratio.
$O_{2E}$ = Predetermined Excess Oxygen Factor.
AF = Measured Kiln Air Flow, (lbs./hr.)
i = Fuel index:
1 = conduit 32;
2 = conduit 36
3 = conduit 38;

4=conduit 30
5=conduit 34.

The kiln air flow can be measured by any suitable means, for example the total kiln air flow can be determined according to the following equation:

$$AF = Y_1 \sqrt{\Delta P_1/(T_K + 460)}$$

where:

$\Delta P_1$=Difference in Signals 132 and 128, psi.
$T_K$=Temperature, signal 82, °F.
$Y_1$=Predetermined constant.

Alternately the kiln air flow can be determined by summing air flows indicated by flow meters, not shown, for primary and secondary air supplied to the kiln.

In response to signals 272 and 288 low select block 274 provides an output signal 296 which is representative of the lowest flow rate of signals 288 and 272. Signal 296 is provided from low select block 274 as a set point input to flow controller 304 illustrated in FIG. 1. Flow controller 304 is also provided with signal 116 which is representative of the actual flow rate in conduit means 32. In response to signals 116 and 296 flow controller 304 provides an output signal 312 representative of the position of control valve 48 required to maintain the flow rate of waste fuel in conduit means 32 substantially equal to the flow rate represented by signal 296. Signal 312 is provided from controller 304 to control valve 48 and control valve 48 is manipulated in response to signal 312.

In a similar manner signals 298 and 302 are provided from low select blocks 282 and 286 respectively as set point inputs to flow controllers 306 and 310 respectively. Flow controller 306 and 310 are also provided with signals 120 and 114 respectively and provide output signals 314 and 316 respectively which are representative of the position of control valves 52 and 46 respectively. Signals 314 and 316 are provided from flow controllers 306 and 310 to control valves 52 and 58 respectively, and control valves 52 and 48 are manipulated in response to signals 314 and 316 respectively.

In response to signals 278 and 292 low select block 284 provides an output signal 300 which is representative of the lowest flow rate of signals 278 and 292. Signal 300 is provided from low select block 284 as an input to speed controller 318 associated with motor 308. In response to signal 300 the speed of motor 308 is manipulated to maintain the flow rate of waste fuel in conduit means 38 substantially equal to the flow rate represented by signal 300.

Figure 5:
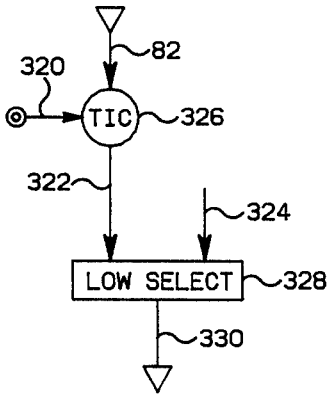
FIG. 5 is a block diagram of the preferred computer logic utilized to implement the desired auxiliary fuel control functions for a kiln section of an incinerator.

Referring now to FIG. 5 signal 82 which is representative of the actual temperature of the kiln 12 is provided as an input to temperature controller 326. Temperature controller 326 is also provided with set point signal 320 which is representative of the minimum temperature of the kiln as determined from Table I. In response to signals 320 and 82 temperature controller 326 provides an output signal 322 which is scaled to be representative of the flow rate of the auxiliary fuel in conduit 34 required to maintain the actual temperature of the kiln 12 substantially equal to the temperature represented by set point signal 320. Signal 322 is provided from temperature controller 326 as a first input to low select lock 328. Low select lock 328 is also provided with signal 324 which is representative of the air flow required for combustion of fuel supplied to the kiln 12 through conduit 34. Signal 324 is computed from the general equation as previously mentioned for computing limiting air flow signals for low select blocks 274, 288, 284 and 286.

In response to signals 322 and 324 low select block 328 provides an output signal 330 which is representative of the lowest flow rate represented by signals 322 and 324. Signal 330 is provided from low select block 328 as a set point input to flow controller 322. Flow controller 322 is also provided with signal 92 which is representative of the actual flow rate of auxiliary fuel flow in conduit means 34. In response to signals 330 and 92 flow controller 332 provides an output signal 334 which is scaled so as to be representative of the position of control valve 54 required to maintain the actual flow rate in conduit means 34 substantially equal to the flow rate represented by signal 330. Signal 334 is provided from flow controller 332 to control valve 54 and control valve 54 is manipulated in response to signal 334.

Figure 6:
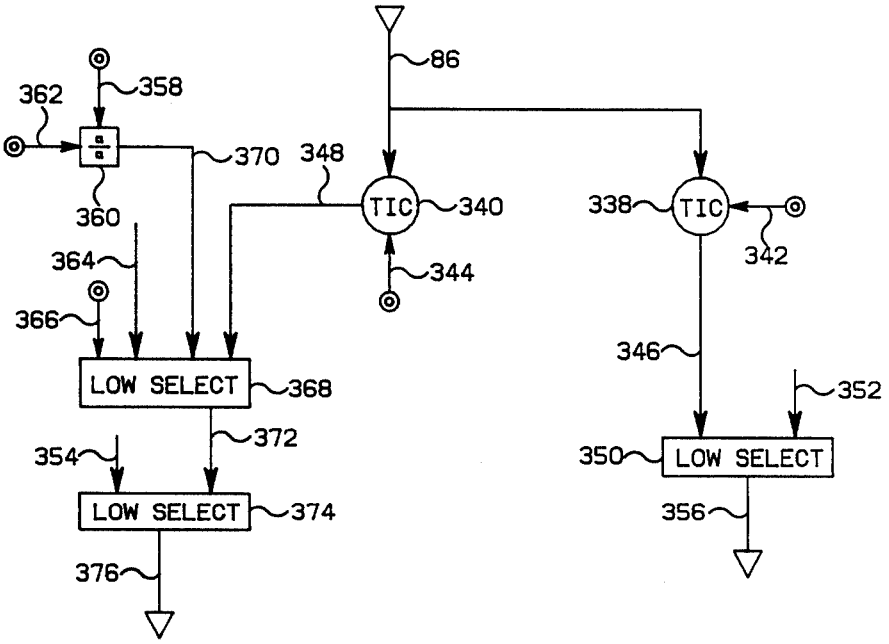
FIG. 6 is a block diagram of the preferred computer logic utilized to implement the desired waste fuel and auxiliary fuel control functions for an afterburner section of the incinerator.

Referring now to FIG. 6, signal 86 which is representative of the actual temperature of the afterburner is provided as a process variable input to temperature controller 338 and temperature controller 340. Temperature controller 338 is also provided with set point signal 342 which is representative of the minimum permitted temperature for afterburner 16. In response to signals 86 and 342 temperature controller 348 provides an output signal 346 which is representative of the flow rate of the auxiliary fuel to the afterburner 16 required to maintain the actual temperature in afterburner 16 substantially equal to the temperature represented by set point signal 342.

Temperature controller 340 is also provided with set point signal 344 which is representative of the maximum temperature permitted in afterburner 16. In response to signals 86 and 344 temperature controller 340 provides an output signal 348 which is representative of the flow rate of waste fuel in conduit 40 required to maintain the actual temperature in afterburner 16 substantially equal to the set point signal represented by signal 344. Signal 348 is provided from temperature controller 340 as a first input to low select block 368.

Signal 362, which is representative of the maximum permitted heat release rate for the high heat value waste fuel as determined from Table I for the fuel supply to afterburner, 16 is provided as a numerator input to division block 360. Signal 358 which is representative of the heating value of the fuel flowing in conduit means 40 is provided to the denominator input of division block 360. Signal 362 is divided by signal 358 in division block 360 to establish signal 370 which is representative of a maximum flow rate for the waste fuel supplied to afterburner 16 through conduit means 40 based on the maximum permitted heat release for the high heat value fuel supplied to afterburner 16 as determined in Table I. Signal 370 is provided from division block 360 as a second input to low select block 368.

Signal 364 which is representative of a maximum value for the flow rate of waste fuel flowing in conduit means 40 is responsive to the total heat release rate of all fuels supplied to the incinerator other than the fuel supply to afterburner 16 through conduit means 40. Signal 364 is a calculated signal in accordance with the following equation:

$$MXF = \left( MXH - \sum_{1}^{6} M_i H_i \right) / H_7$$

where:

MXF=Maximum Flow Rate for High Heat Waste Fuel to Afterburner, Signal 364, (lbs./hr.).

MXH=Maximum Heat Release for Total Incinerator (MM BTU/hr.)

M=Measured Flow Rate (lbs./hr.)

H=Heating Value (BTU/lb.)

i=Fuel Index

1=conduit 32,

2=conduit 36

3=conduit 38,

4=conduit 40

5=conduit 34

6=conduit 41

7=conduit 40

Signal 364 is provided as a third input to low select block 368. If desired signal 366 which is an operator entered value for a maximum flow rate in conduit means 40 can be provided to low select block 368.

In response to the plurality of flow rate signals low select block 368 provides an output signal 372 which is representative of the lowest flow rate represented by the plurality of signals provided to low select block 368. Signal 372 is provided from low select block 368 as a first input to low select block 374.

Signals 354 and 352 are signals which limit the fuel flow for the afterburner to the available air flow, and are calculated in a manner similar to the calculation of signals 288, 290, 292 and 294 in accordance with the following equation:

$$A_i = \left( M_i R_i / \sum_{6}^{7} M_i R_i \right) (AF/(R_i)(O_{2E})$$

where:

M=Measured Flow Rate (lbs./hr.).

R=Predetermined Air to Fuel Ratio.

$O_{2E}$=Predetermined Excess Oxygen Factor.

AF=Measured Afterburner Air Flow, (lbs./hr.).

i=Fuel Index: 6, 7

6=conduit 40,

7=conduit 41.

The afterburner air flow can be measured by any suitable means for example the total afterburner air flow can be determined according to the following equation $$AF = Y_2 \sqrt{\Delta P_2/(T_{AB} + 460)}$$

where:

$\Delta P_2$=Difference in Signals 132 and 93, (psi).

$T_{AB}$=Temperature Signal 86.

$Y_2$=Predetermined Constant.

In response to signals 354 and 372 low select block 374 provides an output signal 376 which is representative of the lowest flow rate represented by signals 354 and 372. Signal 376 is provided from low select block 374 as a set point input to flow controller 378 illustrated in FIG. 1. Flow controller 378 is also provided with signal 122 which is representative of the actual flow rate of the waste fuel flowing in conduit means 40. In response to signals 376 and 122 flow controller 378 provides an output signal 384 which is representative of the position of control valve 50 required to maintain the actual flow rate in conduit means 40 substantially equal to the flow rate represented by signal 376. Signal 384 is provided from flow controller 378 to control valve 50 and control valve 50 is manipulated in response to signal 384.

In summary, the control system of the present invention will insure that the incinerator will operate within all temperature permit limits by automatically manipulating the flow rate of all waste fuel streams and of the auxiliary fuel. Further the control system will automatically switch between natural gas and waste fuel to maintain operating conditions, and will limit the fuel to the available air.

The invention has been described in terms of a presently preferred embodiment as illustrated in FIGS. 1–6. Specific components which can be used in the practice of the invention as illustrated in FIG. 1 such as flow transducers 88, 90, 92, 94, 96 and 98; pressure transducers 126, 130 and 91; temperature transducers 80 and 84; control valves 46, 48, 50, 52, 54 and 56; and flow controllers 310, 304, 332, 306, 328 and 380 are each well known, commercially available control components such as are described at length in Perry's Chemical Engineer's Handbook, 4th Edition, Chapter 22, McGraw-Hill. The controllers illustrated in FIGS. 3, 5 and 6 as well as the calculation blocks and the select circuits illustrated in FIGS. 3–6 may be implemented by using a digital computer such as the Optrol DCS® manufactured by Applied Automation, Inc.

For reasons of brevity, conventional auxiliary equipment such as pumps, heat exchangers, additional measurement control devices, etc. have not been included in the above description as they play no part in the explanation of the invention.

While the invention has been described in terms of the presently preferred embodiment, reasonable modifications and variations are possible by those skilled in the art and such modifications and variations are within the scope of the described invention and the appended claims. Variations such as using maximum flow constraints for different waste fuel streams are in particular within the scope of the invention.

That which is claimed is:

1. Apparatus comprising:

an incinerator having a combustion zone;

means for supplying a first waste fuel to said combustion zone and for burning said first waste fuel in said combustion zone, wherein the heating valve of said second waste fuel is less than the heating value of said first waste fuel;

means for supplying an auxiliary fuel to said combustion zone and for burning said auxiliary fuel in said combustion zone;

means for establishing a first signal representative of a first maximum flow rate for said first waste fuel, wherein said first signal is responsive to the actual heat release rate of said second waste fuel;

means for establishing a second signal representative of a second maximum flow rate for said first waste fuel, wherein said second signal is responsive to the actual heat release rate of said second waste fuel and the actual heat release rate of said auxiliary fuel;

a first low select means;

means for providing said first signal and said second signal to said first low select means and for establishing a third signal which is equal to the one of said first and second signals representative of the lowest flow rate; and means for manipulating the flow rate of said first waste fuel in response to said third signal, whereby the flow rate of said first waste fuel is regulated with respect to said second waste fuel with respect to said auxiliary fuel if said third signal is equal to said second signal or said first waste fuel is regulated with respect to said second waste fuel if said third signal is equal to said first signal.

2. Apparatus in accordance with claim 1 wherein said means for establishing a first signal comprises:

means for analyzing said first and second waste fuels, before supplying the waste fuels to said combustion zone, to predetermine the heating value of said first and second waste fuels;

means for establishing a fourth signal representative of a maximum heat release rate for said first waste fuel;

means for establishing a fifth signal representative of the actual flow rate of said second waste fuel;

means for establishing a sixth signal representative of the heating value of said second waste fuel;

means for multiplying said fifth signal and said sixth signal to establish a seventh signal representative of the actual heat release rate of said second waste fuel;

means for subtracting said seventh signal from said fourth signal to establish an eighth signal representative of the difference between said fourth signal and said seventh signal;

means for establishing a ninth signal representative of the heating value of said first waste fuel; and means for dividing said eighth signal by said ninth signal to establish said first signal.

3. Apparatus in accordance with claim 2 wherein said means for establishing a second signal comprises:

means for establishing a tenth signal representative of the actual flow rate of said auxiliary fuel;

means for analyzing said auxiliary fuel, before supplying the auxiliary fuel to said first combustion zone, to predetermine the heating value of said auxiliary fuel;

means for establishing an eleventh signal representative of the actual heating value of said auxiliary fuel;

means for multiplying said tenth signal and said eleventh signal to establish a twelfth signal representative of the actual heat release rate of said auxiliary fuel;

means for summing said twelfth signal and said seventh signal to establish a thirteenth signal representative of the total heat release rate of said second waste fuel and said auxiliary fuel;

means for establishing a fourteenth signal representative of the maximum heat release rate for the total incinerator;

means for subtracting said thirteenth signal from said fourteenth signal to establish a fifteenth signal which is representative of the difference between said fourteenth signal and said thirteenth signal; and means for dividing said fifteenth signal by said ninth signal to establish said second signal.

4. Apparatus in accordance with claim 3 wherein said means for manipulating the flow rate of said first waste fuel in response to said third signal comprises:

a first control valve operably located so as to manipulate the flow rate of said first waste fuel;

means for establishing a sixteenth signal representative of the actual flow rate of said first waste fuel;

means for comparing said sixteenth signal and said third signal and for producing a seventeenth signal representative of the comparison, wherein said seventeenth signal is scaled so as to be representative of the position of said first control valve required to maintain the actual flow rate of said first waste fuel substantially equal to the desired flow rate represented by said third signal; and means for manipulating said first control valve in response to said seventeenth signal.

5. Apparatus in accordance with claim 4 additionally comprising:

means for supplying a third waste fuel to said combustion zone and for burning said third waste fuel in said combustion zone;

means for supplying a solid waste fuel to said combustion zone and for burning said solid waste fuel in said combustion zone;

means for establishing an eighteenth signal representative of the heat release rate of said third waste fuel;

means for establishing a nineteenth signal representative of the heat release rate of said solid fuel;

means for summing said seventh signal and said eighteenth and nineteenth signals to establish a twentieth signal which is representative of the total heat release rate for said second and third waste fuels and said solid fuel; and means for subtracting said twentieth signal from said fourth signal to establish said eighth signal, and for summing said twentieth signal and said twelfth signal to establish said thirteenth signal.

6. Apparatus in accordance with claim 3 additionally comprising:

means for establishing a twenty-fourth signal representative of a first maximum flow rate for said second waste fuel, wherein said twenty-fourth signal is responsive to the actual heat release rate of said first waste fuel;

means for establishing a twenty-fifth signal representative of a second maximum flow rate for said second waste fuel, wherein said twenty-fifth signal is responsive to the actual heat release of said first waste fuel and the actual heat release of said auxiliary fuel;

a second low select means;

means for providing said twenty-fourth signal and said twenty-fifth signal to said second low select means and for establishing a twenty-sixth signal which is equal to the one of said twenty-fourth and twenty-fifth signals representative of the lowest heat release rate; and means for manipulating the flow rate of said second waste fuel in response to said twenty-sixth signal.

7. Apparatus in accordance with claim 6 wherein said means for manipulating the flow rate of said second waste fuel in response to said twenty-sixth signal comprises:

a second control valve operably located so as to manipulate the flow rate of said second waste fuel;

means for comparing said twenty-sixth signal and said fifth signal and for producing a twenty-seventh signal representative of the comparison, wherein said twenty-seventh signal is scaled so as to be representative of the position of said second control valve required to maintain the actual flow rate of said second waste fuel substantially equal to the desired flow rate represented by said twenty-sixth signal; and means for manipulating said second control value in response to said twenty-seventh signal.

8. Apparatus in accordance with claim 3 additionally comprising:

means for establishing a twenty-first signal representative of the actual temperature of said combustion zone;

means for establishing a twenty-second signal representative of the maximum temperature permitted in said combustion zone;

means for comparing said twenty-first signal and said twenty second signal and for establishing a twenty-third signal responsive to the difference between said twenty-first and twenty-second signal, wherein said twenty-third signal is a split-range signal with a first split-range scaled to be representative of the flow rate of said first waste fuel required to maintain the actual temperature of said combustion zone substantially equal to the maximum permitted temperature represented by said twenty-second signal; and means for providing said twenty-third signal to said first low select means wherein the lower of said first signal and second signal and twenty-third signal is provided as said third signal from said low select means.

9. Apparatus in accordance with claim 8 additionally comprising:

means for providing said twenty-third signal to said second low select means, wherein said twenty-third signal is a split-range signal with a second split-range scaled to be representative of the flow rate of said second waste fuel required to maintain the actual temperature of said combustion zone substantially equal to the maximum permitted temperature represented by said twenty-second signal; and means for providing said twenty-third signal to said second low select means wherein the lower of said twenty-fourth and twenty-fifth and twenty-third signal is provided as said twenty-sixth signal from said second low select means.

10. Apparatus in accordance with claim 9 wherein said second split-range of said twenty-third signal that is provided to said second low select means includes the lower portion of the full range of said twenty third signal whereby the flow rate of said second waste fuel is reduced in response to increasing temperature prior to reducing the flow rate of said first waste fuel.

11. Apparatus in accordance with claim 3 wherein the maximum heat release rate represented by said fourth signal and said fourteenth signal provides ample activation energy for the combustion reaction to proceed.

12. Apparatus in accordance with claim 11 wherein said means for establishing said fourth signal and said fourteenth signal which are both representative of a maximum heat release rate for said first waste fuel additionally comprises:

means for constructing a list of incinerator operating conditions for an analyzed batch of waste, wherein said list includes maximum heat release rates for high heat value waste fuels and a maximum total heat release rate for said incinerator, which must be observed to allow complete combustion of said analyzed batch of waste.

13. Apparatus in accordance with claim 12 wherein said auxiliary fuel is fuel oil.

14. Apparatus in accordance with claim 12 wherein said auxiliary fuel is natural gas.

15. Apparatus in accordance with claim 14 wherein the heating value of said first waste fuel as represented by said ninth signal is not less than 16,000 BTU/lb.

16. Apparatus comprising:

an incinerator having a combustion zone;

means for supplying a waste fuel to said combustion zone and for burning said waste fuel in said combustion zone;

means for supplying an auxiliary fuel to said combustion zone and for burning said auxiliary fuel in said combustion zone;

means for establishing a first signal representative of a first maximum flow rate for said waste fuel wherein said first signal is responsive to the actual heat release rate of said auxiliary fuel;

means for establishing a second signal representative of a second maximum flow rate for said waste fuel wherein said second signal is responsive to the maximum temperature permitted in said combustion zone;

a first low select means;

means for providing said first and second signals to said first low select means and for establishing a third signal which is equal to the one of said first and second signals representative of the lowest flow rate; and means for manipulating the flow rate of said waste fuel in response to said third signal.

17. Apparatus in accordance with claim 16 wherein said waste fuel is a solid material having a heating value of less than 16,000 BTU/lb.

18. Apparatus in accordance with claim 16 wherein said waste fuel is a waste oil having a heating value not less than 16,000 BTU/lb. and wherein said auxiliary fuel is natural gas.

19. Apparatus in accordance with claim 16 additionally comprising:

means for establishing a fourth signal representative of a third maximum flow rate for said waste fuel wherein said third signal is responsive to the desired pressure in said combustion zone;

means for establishing a fifth signal representative of a fourth maximum flow rate for said waste fuel wherein said fifth signal is responsive to the combustion air available in said combustion zone; and means for providing said fourth signal and said fifth signal to said first low select means and for establishing said third signal wherein said third signal is equal to the one of said first, second, fourth and fifth signals representative of the lowest flow rate.

20. Apparatus in accordance with claim 19 wherein said means for establishing a first signal comprises:

means for analyzing said waste fuel and said auxiliary fuel to predetermine the heating value of said waste fuel and said auxiliary fuel;

means for establishing a seventh signal representative of a maximum heat release rate for said combustion zone;

means for establishing an eighth signal representative of the actual flow rate of said auxiliary fuel;

means for establishing a ninth signal representative of the actual heating value of said auxiliary fuel;

means for establishing a tenth signal representative of the actual heating value of said waste fuel;

means for multiplying said eighth signal and said ninth signal to establish an eleventh signal representative of the actual heat release rate of said auxiliary fuel;

means for subtracting said eleventh signal from said seventh signal to establish a twelfth signal which is representative of the difference between said twelfth signal and said seventh signal; and means for dividing said twelfth signal by said tenth signal to establish said first signal.

21. Apparatus in accordance with claim 20 wherein said means for establishing a second signal responsive to the maximum temperature permitted in said combustion zone, and for establishing said seventh signal representative of a maximum heat release rate for said combustion zone additionally comprises:

means for constructing a list of incinerators operating conditions for an analyzed batch of waste, wherein said list includes maximum and minimum temperatures and maximum heat release rates for high heat value waste fuels and maximum total heat release rate for said incinerator, which must be observed to allow complete combustion of said analyzed batch of waste.

22. Apparatus in accordance with claim 21 wherein said means for manipulating the flow rate of said waste fuel in response to said third signal comprises:

a first control valve operably located so as to manipulate the flow of said waste fuel;

means for establishing a thirteenth signal representative of the actual flow rate of said waste fuel;

means for comparing said thirteenth signal and said third signal and for producing a fourteenth signal representative of the comparison, wherein said fourteenth signal is scaled so as to be representative of the position of said first control valve required to maintain the actual flow rate of said waste fuel substantially equal to the flow rate represented by said third signal; and means for manipulating said first control valve in response to said fourteenth signal.

23. Apparatus in accordance with claim 22 additionally comprising:

a second control valve operably located so as to manipulate the flow of said auxiliary fuel;

means for establishing a fifteenth signal representative of the actual temperature of said combustion zone;

means for establishing a sixteenth signal representative of a minimum permitted temperature for said combustion zone;

means for comparing said fifteenth signal and said sixteenth signal and for establishing a seventeenth signal representative of the comparison wherein said seventeenth signal is scaled so as to be representative of the flow rate of said auxiliary fuel required to maintain the temperature of said combustion zone substantially equal to the minimum temperature represented by said sixteenth signal;

means for establishing an eighteenth signal representative of a maximum flow rate for said auxiliary fuel wherein said eighteenth signal is responsive to the actual combustion air flow to said combustion zone;

a second low select means;

means for providing said seventeenth signal and said eighteenth signal to said second low select means and for establishing a nineteenth signal which is equal to the one of said seventeenth and eighteenth signals representative of the lowest flow rate; and means for manipulating the flow rate of said auxiliary fuel in response to said nineteenth signal.

24. Apparatus in accordance with claim 22 additionally comprising:

an afterburner for receiving combustion gases from said combustion zone;

means for supplying said waste fuel to said afterburner and for burning said waste fuel in said afterburner;

means for supplying said auxiliary fuel to said afterburner and for burning said auxiliary fuel in said afterburner;

means for establishing a twentieth signal representative of the actual temperature of combustion gases exiting said afterburner;

means for establishing a twenty-first signal representative of a maximum temperature for said combustion gases exiting said afterburner;

means for comparing said twentieth and said twenty-first signals and for establishing a twenty-second signal representative of the comparison, wherein said twenty-second signal is scaled so as to be representative of the flow rate of said waste fuel to said afterburner required to maintain the actual temperature of said afterburner as represented by said sixteenth signal substantially equal to maximum temperatures represented by said fifteenth signal;

means for establishing a twenty-third signal representative of the maximum permitted flow rate of said waste fuel to said afterburner;

means for establishing a twenty-fourth signal representative of a maximum value for said waste fuel to said afterburner wherein said twenty-fourth signal is responsive to the actual combustion air flow to said afterburner;

a third low select means;

means for providing said first signal and said twenty-second, twenty-third, and twenty-fourth signals to said third low select means and for establishing a twenty-fifth signal which is equal to the one of said first signal and said twenty-second, twenty-third and twenty-fourth signals which is representative of the lowest flow rate;

means for manipulating the flow rate of said waste fuel to said afterburner in response to said twenty-fifth signal.

25. A method for controlling an incineration process wherein at least first and second waste fuels and an auxiliary fuel are supplied to an incinerator, said method comprising the steps of:

establishing a first signal representative of a first maximum flow rate of said first waste fuel, wherein said first signal is responsive to the actual heat release rate of said second waste fuel establishing a second signal representative of a second maximum flow rate for said first waste fuel, wherein said second signal is responsive to the actual heat release rate of said second waste fuel and the actual heat release rate of said auxiliary fuel;

establishing a third signal which is equal to the one of said first and said second signals representative of the lowest flow rate; and manipulating the flow rate of said first waste fuel in response to said third signal whereby the flow rate of said first waste fuel is regulated with respect to said second waste fuel and with respect to said auxiliary fuel if said third signal is equal to said second signal or said first waste fuel is regulated with respect to said second waste fuel if said third signal is equal to said first signal.

26. A method in accordance with claim 25 wherein the step of establishing said first signal comprises:

analyzing said first and second waste fuels to predetermine the heating value of said first and second waste fuels;

establishing a fourth signal representative of a maximum heat release rate for said first waste fuel;

establishing a fifth signal representative of the actual flow rate of said second waste fuel;

establishing a sixth signal representative of the heating value of said second waste fuel;

multiplying said fifth signal and said sixth signal to establish a seventh signal representative of the actual heat release rate of said second waste fuel;

subtracting said seventh signal from said fourth signal to establish an eighth signal representative of the difference between said fourth signal and said seventh signal;

establishing a ninth signal representative of the heating value of said first waste fuel; and dividing said eighth signal by said ninth signal to establish said first signal.

27. A method in accordance with claim 26 wherein the step for establishing said second signal comprises:

establishing a tenth signal representative of the actual flow rate of said auxiliary fuel;

analyzing said auxiliary fuel to predetermine the heating value of said auxiliary fuel;

establishing an eleventh signal representative of the actual heating value of said auxiliary fuel;

multiplying said tenth signal and said eleventh signal to establish a twelfth signal which is representative of the actual heat release rate of said auxiliary fuel;

summing said twelfth signal and said seventh signal to establish a thirteenth signal representative of the total heat release rate of said second waste fuel and said auxiliary fuel;

establishing a fourteenth signal representative of the maximum heat release rate for the total incinerator;

subtracting said thirteenth signal from said fourteenth signal to establish a fifteenth signal which is representative of the difference between said fourteenth signal and said thirteenth signal; and dividing said fifteenth signal by said sixteenth signal to establish said second signal.

28. A method in accordance with claim 27 wherein a first control valve is operably located so as to manipulate the flow rate of said first waste fuel, and wherein said step of manipulating the flow rate of said first waste fuel in response to said third signal comprises:

establishing a sixteenth signal representative of the actual flow rate of said first waste fuel;

comparing said sixteenth signal and said third signal and for producing a seventeenth signal which is representative of the comparison, wherein said seventeenth signal is scaled so as to be representative of the position of said first control valve required to maintain the actual flow rate of said first waste fuel substantially equal to the desired flow rate represented by said third signal; and manipulating said first control valve in response to said seventeenth signal.

29. A method in accordance with claim 28 wherein a third waste fuel is supplied to said combustion zone through a control valve, and wherein a solid waste fuel is supplied to said combustion zone through an auger feeder, said method additionally comprising the steps of:

establishing an eighteenth signal representative of the heat release rate of said third waste fuel;

establishing a nineteenth signal representative of the heat release rate of said solid fuel;

summing said seventh signal and said eighteenth signal and nineteenth signal to establish a twentieth signal which is representative of the total heat release rate for said second and third waste fuels and said solid fuel; and subtracting said twentieth signal from said fourth signal to establish said eighth signal, and for summing said twentieth signal and said twelfth signal to establish said thirteenth signal.

30. A method in accordance with claim 27 additionally comprising the steps of:

establishing a twenty-fourth signal representative of a first maximum flow rate for said second waste fuel, wherein said twenty-fourth signal is responsive to the actual heat release rate of said first waste fuel;

establishing a twenty-fifth signal representative of a second maximum flow rate for said second waste fuel, wherein said twenty-fifth signal is responsive to the actual heat release rate of said first waste fuel and the actual heat release rate of said auxiliary fuel;

establishing a twenty-sixth signal which is equal to the one of said twenty-fourth and twenty-fifth signals representative of the lowest heat release rate; and manipulating the flow rate of said second waste fuel in response to said twenty-sixth signal.

31. A method in accordance with claim 30 wherein a second control valve is operably located so as to manipulate the flow rate of said second waste fuel and wherein said step of manipulating the flow rate of said second waste fuel in response to said twenty-sixth signal comprises:

comparing said twenty-sixth signal and said fifth signal and for producing a twenty-seventh signal representative of the comparison, wherein said twenty-seventh signal is scaled so as to be representative of the position of said second control valve required to maintain the actual flow rate of said second waste fuel substantially equal to the desired flow rate represented by said twenty-sixth signal; and manipulating said second control valve in response to said twenty-seventh signal.

32. A method in accordance with claim 27 additionally comprising the steps of:

establishing a twenty-first signal representative of the actual temperature of said combustion zone;

establishing a twenty second signal representative of the maximum temperature permitted in said combustion zone;

comparing said twenty-first signal and said twenty-second signal and for establishing a twenty-third signal responsive to the difference between said twenty-first and twenty-second signal, wherein said twenty-third signal is a split-range signal with a first split-range scaled to be representative of the flow rate of said first waste fuel required to maintain the actual temperature of said combustion zone substantially equal to the maximum permitted temperature represented by said twenty-second signal;

selecting the lower of said first signal and second signal and said twenty-third signal to be provided as said third signal.

33. A method in accordance with claim 32 wherein said twenty-third signal is a split-range signal with a second split-range scaled to be representative of the flow rate of said second waste fuel required to maintain the actual temperature of said combustion zone substantially equal to the maximum permitted temperature represented by said twenty-second signal, said method additionally comprising the step of:

selecting the lower of said twenty-fourth and twenty-fifth and twenty-third signals as said twenty-sixth signal.

34. A method in accordance with claim 33 wherein the lower portion of the full-range of said twenty-third signal is selected for said twenty-sixth signal, whereby the flow rate of said second waste fuel is reduced in response to increasing temperature in said combustion zone prior to reducing the flow rate of said first waste fuel.

35. A method in accordance with claim 27 wherein the maximum heat release rate represented by said fourth signal and said fourteenth signal provides ample activation energy for the combustion reaction to proceed.

36. A method in accordance with claim 35 wherein said step of establishing said fourth signal and said fourteenth signal which are both representative of a maximum heat release rate for said first waste fuel additionally comprises:

constructing a list of incinerator operating conditions for an analyzed batch of waste, wherein said list includes maximum heat release rates for high heat value waste fuels and a maximum total heat release rate for said incinerator which must be observed to allow complete combustion of said analyzed batch of waste.

37. A method in accordance with claim 36 wherein said auxiliary fuel is natural gas.

38. A method in accordance with claim 36 wherein said auxiliary fuel is fuel oil.

39. A method in accordance with claim 36 wherein the heating value of said first waste fuel as represented by said ninth signal is not less than 16,000 BTU/lb.

40. A method for controlling an incineration process wherein a waste fuel and an auxiliary fuel are supplied to an incinerator, said method comprising the steps of:

establishing a first signal representative of a first maximum flow rate for said waste fuel wherein said first signal is responsive to the actual heat release rate of said auxiliary fuel;

establishing a second signal representative of a second maximum flow rate for said waste fuel wherein said second signal is responsive to the maximum temperature permitted in said combustion zone;

establishing a third signal which is equal to the one of said first and second signals representative of the lowest flow rate; and manipulating the flow rate of said waste fuel in response to said third signal.

41. A method in accordance with claim 40 additionally comprising the steps of:

establishing a fourth signal representative of a third maximum flow rate for said waste fuel wherein said third signal is responsive to the desired presure in said combustion zone;

establishing a fifth signal representative of a fourth maximum flow rate for said waste fuel wherein said fifth signal is responsive to the combustion air available in said combustion zone; and means for providing said fourth signal and said fifth signal to said first low select means and for establishing said third signal wherein said third signal is equal to the one of said first, second, fourth and fifth signals representative of the lowest flow rate.

42. A method in accordance with claim 41 wherein the step of establishing said first signal comprises:

analyzing said waste fuel and said auxiliary fuel to predetermine the heating value of said waste fuel and said auxiliary fuel;

establishing a seventh signal representative of a maximum heat release rate for said combustion zone;

establishing an eighth signal representative of the actual flow rate of said auxiliary fuel;

establishing a ninth signal representative of the actual heating value of said auxiliary fuel;

establishing a tenth signal representative of the actual heating value of said waste fuel;

multiplying said eighth signal and said ninth signal to establish an eleventh signal representative of the actual heat release rate of said auxiliary fuel;

subtracting said eleventh signal from said seventh signal to establish a twelfth signal which is representative of the difference between said twelfth signal and said seventh signal; and dividing said twelfth signal by said tenth signal to establish said first signal.

43. A method in accordance with claim 42 wherein the step of establishing said second signal responsive to the maximum temperature permitted in said combustion zone, and for establishing said seventh signal representative of a maximum heat release rate for said combustion zone additionally comprises:

constructing a list of incinerator operating conditions for an analyzed batch of waste, wherein said list includes maximum and minimum temperatures for said incinerator and maximum heat release rates for high heat value waste fuels and maximum total heat release rates for said incinerator which must be observed to allow complete combustion of said analyzed batch of waste.

44. A method in accordance with claim 43 wherein a first control valve is operably located so as to manipulate the flow of said waste fuel and wherein said step of manipulating the flow rate of said waste fuel in response to said third signal comprises:

establishing a thirteenth signal representative of the actual flow rate of said waste fuel;

comparing said thirteenth signal and said third signal and for producing a fourteenth signal representative of the comparison, wherein said fourteenth signal is scaled so as to be representative of the position of said first control valve required to maintain the actual flow rate of said waste fuel substantially equal to the flow rate represented by said third signal; and manipulating said first control valve in response to said fourteenth signal.

45. A method in accordance with claim 44 wherein a second control valve is operably located so as to manipulate the flow rate of said auxiliary fuel, said method additionally comprising the steps of:

establishing a fifteenth signal representative of the actual temperature of said combustion zone;

establishing a sixteenth signal representative of a minimum permitted temperature for said combustion zone;

comparing said fifteenth signal and said sixteenth signal and for establishing a seventeenth signal representative of the comparison, wherein said seventeenth signal is scaled so as to be representative of the flow rate of said auxiliary fuel required to maintain the temperature of said combustion zone substantially equal to the minimum temperature represented by said fifteenth signal;

establishing an eighteenth signal representative of a maximum flow rate for said auxiliary fuel wherein said eighteenth signal is responsive to the actual combustion air flow to said combustion zone;

establishing a nineteenth signal which is equal to the one of said seventeenth and eighteenth signals representative of the lowest flow rate; and manipulating the flow rate of said auxiliary fuel in response to said ninteenth signal.

46. A method in accordance with claim 45 wherein an afterburner is provided for receiving combustion gases from said combustion zone, and wherein said waste fuel is supplied to said afterburner and further wherein said auxiliary fuel is supplied to said afterburner, said method additionally comprising the steps of:

establishing a twentieth signal representative of the actual temperature of combustion gases exiting said afterburner;

establishing a twenty-first signal representative of a maximum temperature for said combustion gases exiting said afterburner;

comparing said twentieth and said twenty-first signals and for establishing a twenty-second signal representative of the comparison, wherein said twenty-second signal is scaled so as to be representative of the flow rate of said waste fuel to said afterburner required to maintain the actual temperature of said afterburner as represented by said sixteenth signal substantially equal to the maximum temperature represented by said fifteenth signal;

establishing a twenty-third signal representative of the maximum permitted flow rate of said waste fuel to said afterburner;

establishing a twenty-fourth signal representative of a maximum value for said waste fuel supplied to said afterburner wherein said twenty-fourth signal is responsive to the actual combustion air flow to said afterburner;

establishing a twenty-fifth signal which is equal to the one of said first signal, said twenty-second, twenty-third and twenty-fourth signal which is representative of the lowest flow rate;

manipulating the flow rate of said waste fuel to said afterburner in response to said twenty-fifth signal.

* * * * *

UNITED STATES PATENT AND TRADEMARK OFFICE

CERTIFICATE OF CORRECTION

PATENT NO. : 4,739,714

DATED : April 26, 1988

INVENTOR(S) : Ronald J. LaSpisa et al

It is certified that error appears in the above-identified patent and that said Letters Patent is hereby corrected as shown below:

Column 14, line 49, After "an incinerator having a combustion zone;", please add the following paragraph ---means for supplying a first waste fuel to said combustion zone and for burning said first waste fuel in said combustion zone;---

Column 14, line 50, please delete "first" and insert therefor ---second---.

Column 14, line 51, please delete "first" and insert therefor ---second---.

Column 14, line 52, please delete "valve" and insert therefor ---value---.

Column 15, line 9, after "fuel", please insert ---and---.

Column 19, line 26, please delete "incinerators" and insert therefor ---incinerator---.

Signed and Sealed this

Twenty-eighth Day of March, 1989

*Attest:*

DONALD J. QUIGG

*Attesting Officer*

*Commissioner of Patents and Trademarks*